US006182567B1

(12) United States Patent
Gunschera et al.

(10) Patent No.: US 6,182,567 B1
(45) Date of Patent: Feb. 6, 2001

(54) PRINTING PRESS WITH AN ACTUATOR

(75) Inventors: Frank Gunschera, Nussloch; Roland Hirth, Römerberg, both of (DE)

(73) Assignee: Heidelberger Druckmaschinen Aktiengesellschaft, Heidelberg (DE)

( * ) Notice: Under 35 U.S.C. 154(b), the term of this patent shall be extended for 0 days.

(21) Appl. No.: 09/275,377

(22) Filed: Mar. 24, 1999

(30) Foreign Application Priority Data

Mar. 24, 1998 (DE) ..... 198 12 781
Dec. 22, 1998 (DE) ..... 198 59 358

(51) Int. Cl.[7] ..... B41F 13/24; B07B 4/00; B65H 5/22

(52) U.S. Cl. ..... 101/232; 271/7; 101/416.1; 209/147

(58) Field of Search ..... 101/231, 232, 101/408, 416.1; 271/3.01, 7, 97, 228, 229, 233, 234; 209/147; 29/DIG. 73, DIG. 78

(56) References Cited

U.S. PATENT DOCUMENTS 4,993,885 * 2/1991 Lazzari ..... 406/89
5,222,726 * 6/1993 Vits ..... 271/195
5,265,536 * 11/1993 Millard ..... 101/424.2
5,581,908 * 12/1996 Theilacker ..... 34/634
5,964,155 * 10/1999 Platsch ..... 101/424.2

FOREIGN PATENT DOCUMENTS 43 25 251 A1 2/1995 (DE) .
197 09 083 C1 10/1997 (DE) .

OTHER PUBLICATIONS

English abstract for SU 1305080, Sergeev et al. Apr. 1987.*
English abstract for DE 4325251, Theilacker, K. Feb. 1995.*
English abstract for DE 3638457, Koch et al. Oct. 1987.*
English abstract for DE 19709083, Wenzel, J. Oct. 1998.*
German Utility Model GM 75 13 266, dated Aug. 26, 1976, device for aligning printed sheets in the stacking area of a printing press.

* cited by examiner

*Primary Examiner*—Kimberly Asher
(74) *Attorney, Agent, or Firm*—Herbert L. Lerner; Laurence A. Greenberg; Werner H. Stemer

(57) ABSTRACT

A printing press having an actuator, includes a chamber partly surrounding the actuator and having a pressure prevailing therein that is greater than the pressure in the outer surroundings of the chamber.

2 Claims, 6 Drawing Sheets

Fig. 4
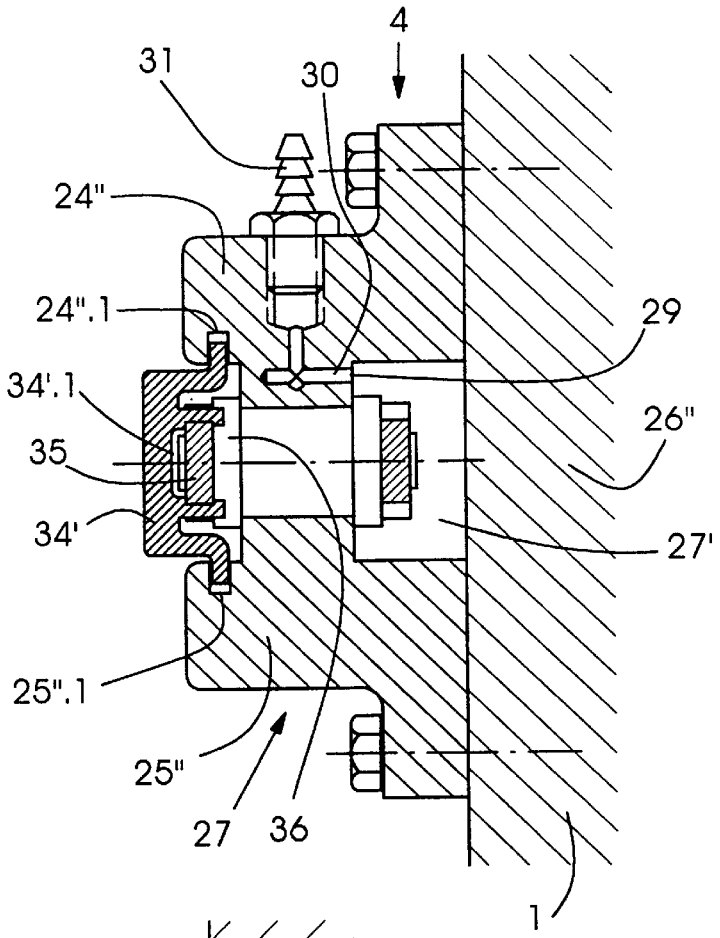
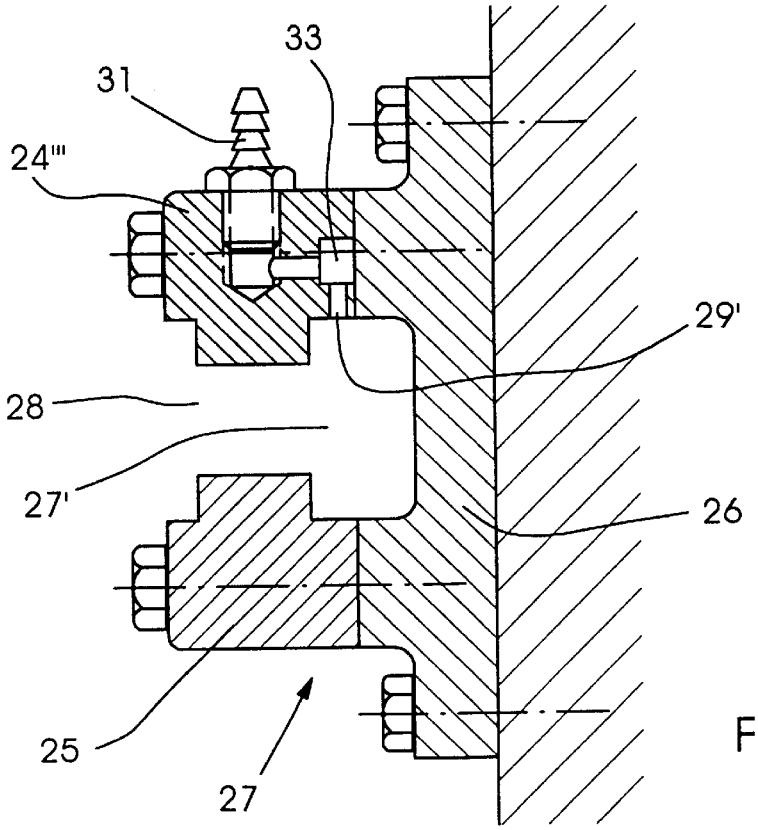
Fig. 5

PRINTING PRESS WITH AN ACTUATOR

BACKGROUND OF THE INVENTION

FIELD OF THE INVENTION

The invention relates to a printing press having an actuator and a chamber partly surrounding the actuator.

A printing press includes various kinds of actuators, which are used in the atmosphere prevailing in the printing press. As a rule, this atmosphere is laden with volatile components of printing inks and coatings and, particularly in the region of a delivery of a sheet-fed printing press, it is additionally laden with a powder used for dusting freshly printed sheets.

This actuator, for example, includes a conveyor chain of a chain conveyor, an axially oscillating tappet of a jogger, or a gear wheel of an adjusting drive mechanism for a sheet brake, or the like, the gear wheel meshing with a rack.

An actuator that includes a conveyor chain of a chain conveyor and a chamber partly surrounding the actuator have become known heretofore, for example, from the published German Patent Document DE 43 25 251 A1. The chamber disclosed therein is formed of two opposed guide rails and a mounting support carrying the latter which, together with the guide rails, forms a profile rail of C-shaped cross section, so that the chamber forms an elongated interior with an open long side. The actuator partly surrounded by this chamber serves to draw a web of printing material into a dryer downstream of a web-fed rotary printing press; the conveyor chain is embodied, in particular, as a roller chain, to which an infeed element engaging the web of printing material is secured. In an exemplary embodiment, the open long side is covered by elastic leaves or plates in a manner that the leaves avoid or evade the infeed element along the path thereof past the open long side and, on a side of the infeed element that is upline, as viewed in the infeed direction, cover a portion of the long side again that is temporarily uncovered because of the avoidance or evasion. The interior of the chamber is thus exposed to the atmosphere prevailing in the dryer only via a gap that migrates during the infeeding of the web and is thus largely protected against penetration by volatile components contained in printing inks, which would otherwise condense again in the interior and thereby contaminate or soil the roller chain and the guide rails.

Using a chain conveyor of this type, that is protected against contamination, for transporting sheets in a sheet-fed printing press would not, however, achieve the protective effect attainable when the heretofore known device is used as intended. Instead, it would simultaneously produce a plurality of gaps corresponding to the gap described hereinabove, wherever a gripper system, transporting the sheets as the gripper system revolves during operation, is located, and these gaps would revolve along the chain conveyor at the processing speed.

Thus, the interior would be in communication constantly, although at varying locations, with the ambient atmosphere along the temporarily covered open long side of the interior chamber. Effective protection against the penetration by floating substances into the interior would consequently not be achieved, even though, in sheet-fed printing presses, powder particles occur as additional floating substances which, depending upon the composition thereof, do not only have a contaminating or soiling, but also an abrasive effect. Furthermore, the leaves would be subject to considerable wear, on the one hand, because of friction between the gripper systems and the leaves that are prestressed in the closing direction by their evasive motion and, on the other hand, because of the deformations of the leaves that occur during the sheet processing cycle.

An actuator that includes a tappet, which oscillates axially during operation, and forms part of a jogger for aligning sheets transferred to a pile has become known heretofore, for example, from the German Utility Model (DE-GM) 75 13 266. This tappet is composed of a rod that carries a tappet plate and, to adjust to the size of sheets to be aligned, is received adjustably in the longitudinal direction of the rod and fixably in a sleeve; an adjusting screw inserted into the sleeve and engaging a longitudinal groove of the rod serves for fixing it. The sleeve is, in turn, received longitudinally displaceably in a locally stationary bearing bushing; it is secured against being rotated about the longitudinal axis thereof and, on an end of the sleeve that protrudes past the bearing bushing on a side towards an impact plate, it has a cam follower in the form of a ball bearing, that is positioned against or in engagement with an axial cam by which the tappet is periodically oscillatingly adjustable in the longitudinal direction thereof. The adjusting force of the axial cam counteracts a restoring force on the part of a spring. This spring is supported, at one end thereof, on an end face of the bearing bushing distal from the impact plate and, on the other end thereof, in a cap which is thrust onto a portion of the sleeve protruding past this face end and is axially secured against the action of the spring. To secure the sleeve and thus the impact plate against rotation or torsion about the longitudinal axis of the assembled tappet, the sleeve has a further ball bearing, which is braced on a guiding surface. To assure suitable protection of the aforementioned longitudinal groove from a deposition of powder therein, this longitudinal groove is mounted on the underside of the rod. The aforementioned ball bearings, conversely, when the jogger is used as intended, are exposed fully and completely to a powder-laden atmosphere and therefore require careful maintenance.

An actuator that includes a gear wheel meshing with a rack and forming part of an adjusting drive mechanism for a sheet brake, and a chamber partly surrounding the actuator, have become known heretofore from the published German Patent Document DE 197 09 083 C1.

The sheet brake includes a plurality of braking devices and a guide crossbar for carrying them; along the crossbar, the braking devices can each be shifted by a respective adjusting drive mechanism assigned to a given braking device. The respective adjusting drive mechanism in this case is a motor, that is connected to the respective braking device, and that has a transmission block with a power takeoff shaft provided with a gear wheel that meshes with a rack disposed parallel to the guide crossbar. The rack and the guide crossbar, as well as the motor with the transmission block and a respective carriage that supports the applicable braking element in the form of a suction wheel and is movable relative to the guide crossbar, are enclosed by a housing having an opening that extends along the guide crossbar and having a respective support arm, that carries the respective suction wheel and is connected to one of the carriages, protruding therefrom, so that a chamber partly surrounding an actuator is formed. This chamber serves the purpose of reducing the risk of contamination of the device parts located inside the chamber. To improve the sought-after result, the opening of the chamber is provided with a flexible seal in the form of felt or foam, or in the form of a brush.

SUMMARY OF THE INVENTION

It is accordingly an object of the invention to provide a printing machine with an actuator and a chamber partly enclosing the actuator, from which floating or suspended substances are kept as far away as possible.

With the foregoing and other objects in view, there is provided, in accordance with the invention, a printing press having an actuator, comprising a chamber partly surrounding the actuator and having a pressure prevailing therein that is greater than the pressure in the outer surroundings of the chamber.

In accordance with another feature of the invention, the actuator is formed by a conveyor chain, and the chamber is formed by guide rails for guiding the conveyor chain and a holder for carrying the guide rails, the holder, together with the guide rails, forming an interior of the chamber that has an open long side and is otherwise closed to a maximum possible extent.

In accordance with a further feature of the invention, the conveyor chain has cover tabs laterally secured thereto, and the cover tabs, together with the conveyor chain, substantially cover the open long side of the interior.

In accordance with an added feature of the invention, the cover tabs, together with the guide rails, form labyrinth seal gaps.

In accordance with an additional feature of the invention, the actuator includes a gear wheel meshing with a rack.

In accordance with a concomitant feature of the invention, the actuator is formed by a tappet oscillatable axially during operation, and the chamber is formed by a sleeve for guiding the tappet.

The construction according to the invention offers the additional advantage that no physical sealing members subject to wear are required. Moreover, when the actuator is used in a part of the printing press equipped with an ultraviolet (UV) dryer, penetration by ozone, that is produced by such a dryer, into the interior of the chamber is also averted.

In a first feature, the actuator is formed by a conveyor chain, and the chamber is formed by guide rails guiding the conveyor chain and a holder carrying the guide rails which, together with the guide rails, encloses an interior which has an open long side and is otherwise closed to the greatest possible extent.

This feature is preferably provided in a chain conveyor that carries sheets, printed by the printing press, to a stacking station.

In advantageous improvements thereof, provision is made for the conveyor chain to be provided with cover tabs laterally secured thereto, the cover tabs, together with the conveyor chain, substantially cover the open long side of the interior, and the cover tabs together with the guide rails form labyrinth seal gaps.

By providing the cover tabs, an advantage is afforded that relatively little energy is consumed for maintaining the pressure in the chamber. The labyrinth seal gaps also offer the advantage that even if additional physical sealing members in the form of the cover tabs are used, no wear from frictional forces occurs.

As a further feature, the actuator is formed by a tappet that oscillates axially during operation, and the chamber is formed by a sleeve that guides the tappet. This feature is preferably provided in a jogger for laterally aligning sheets during the formation of a sheet pile.

As yet another feature, the actuator includes a gear wheel meshing with a rack.

In this feature, the actuator is preferably used in an adjusting drive mechanism, such as one for a servomotorized adjustment of a sheet braking device on a pressure-free corridor of printed sheets, or for a servomotorized setting of sheet brake devices to the size or format of sheets to be braked thereby.

Other features which are considered as characteristic for the invention are set forth in the appended claims.

Although the invention is illustrated and described herein as embodied in a printing press with an actuator it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 4 is a view like that of FIG. 3, showing a modified embodiment of the cover tabs;

FIG. 5 is a view similar to that of FIG. 2, showing modified connections for supplying the interior of the chamber with compressed air for maintaining the pressure prevailing in the chamber;

DESCRIPTION OF THE PREFERRED EMBODIMENTS

Figure 1:
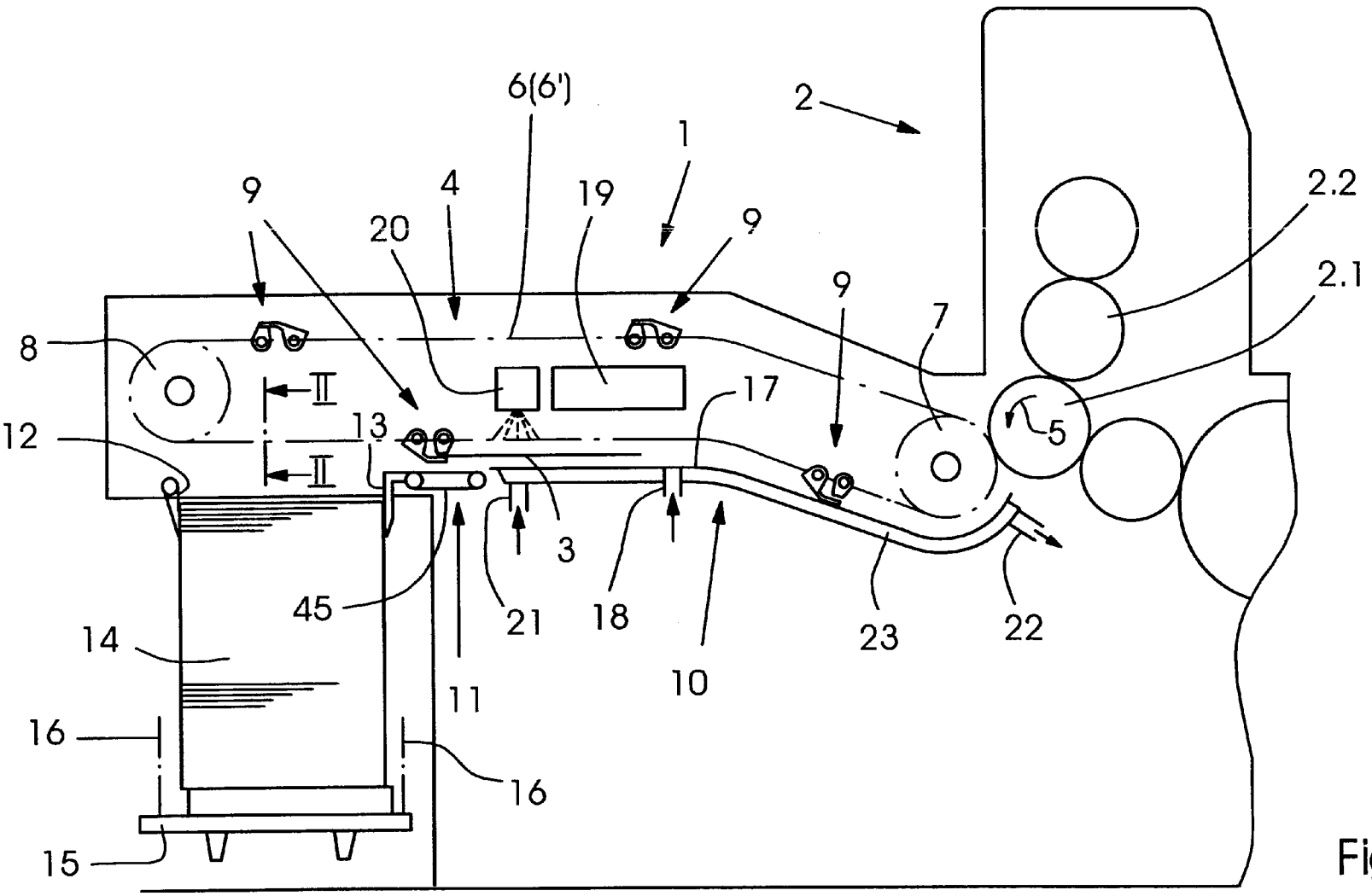
FIG. 1 is a fragmentary, diagrammatic side elevational view of a sheet-fed printing press, showing an end portion thereof including a chain conveyor whereon actuators, which are merely indicated and otherwise not shown in detail herein, are preferably provided.

An actuator that includes a conveyor chain of a chain conveyor can be employed in principle wherever the sheets in a sheet-fed printing press are not transported by drums or cylinders, however, it proves to be especially advantageous where the atmosphere in the printing press has an especially high concentration of floating or suspended substances. Referring now to the drawings and, first, particularly to FIG. 1 thereof, there is shown therein a chain conveyor in a chain delivery system 1 of a sheet-fed printing press, which will therefore serve as a base for the invention, by way of example hereinbelow. The chain delivery system 1 follows a final processing station of the printing press. Such a processing station may be a printing unit or a post-treatment unit, such as a coating or varnishing unit. In the example at hand, the last processing station is a printing unit 2, operating by the offset method, with an impression cylinder 2.1. The impression cylinder 2.1 carries a respective sheet in a processing direction represented by the arrow 5 indicating the direction of rotation through a printing nip between the impression cylinder 2.1 and a rubber blanket cylinder 2.2 cooperating therewith, and finally transfers the sheet to the chain conveyor 4 by opening grippers disposed on the impression cylinder 2.1 for gripping the sheet 3 at a gripper edge on a leading end of the sheet. The chain conveyor 4 includes two actuators 6, each formed by one conveyor chain 6'. A given conveyor chain 6' revolves in operation along a respective side wall of the chain delivery system 1 and wraps around a respective one of two synchronously driven drive chain or sprocket wheels 7, having pivot axes which are aligned with one another, and is each guided, in this example, via a respective deflection chain or sprocket wheel 8 located downline, as viewed in the processing direction, from the drive chain or sprocket wheels 7. Extending between the two conveyor chains 6' and carried thereby are gripper systems 9 provided with grippers, which move through gaps between the grippers disposed on the impression cylinder 2.1 and, in the process, accept a given sheet 3 by gripping the aforementioned gripper edge on the leading end of the sheet 3, immediately prior to the opening of the grippers disposed on the impression cylinder 2.1, and transport the sheet via a sheet guiding device 10 to a sheet brake 11, the latter grippers finally opening so as to transfer the sheet 3 to the sheet brake 11. The sheet brake imparts a reduced deposition speed to the sheets, compared with the processing speed, and then in turn releases them once this speed is reached, so that finally a respective sheet 3, now having been slowed, strikes front edge stops 12 and, being oriented at these stops and on trailing edge stops 13 opposite thereto, together with preceding and/or trailing sheets 3, forms a pile 14, that can be lowered by a lifting mechanism to an extent corresponding to the height to which the pile 14 grows. All that can be seen in FIG. 1 of the lifting mechanism is a platform 15, which supports the pile 14, and lifting chains 16 which carry the platform and are shown in phantom or dot-dash lines.

In the exemplary embodiment diagrammatically shown in FIG. 1, the sheet brake 11 is merely suggested in the form of revolving brake belts 45 having a respective run or strand, which is oriented towards the sheet 3, the brake-band belt temporarily restraining the sheet 3 firmly by pressing it against the brake belts 45 under the influence of a negative pressure. Mechanisms of this type have become known heretofore (note, for example, the German Patent Document DE 36 38 457 C2) and are therefore not described in further detail here. However, further details of a preferred sheet brake 11 will be provided hereinafter with reference to FIG. 8.

The conveyor chains 6' are guided along their path between the drive chain wheels 7, on the one hand, and the deflection chain wheels 8, on the other hand, by guide rails, which thus determine the chain paths of the runs or strands of the chain.

In this embodiment, the sheets 3 are transported by the lower run of the chain, as viewed in FIG. 1. The portion of the chain path that is traversed by this lower chain run is also followed by a sheet guiding surface 17 facing towards it and formed on the sheet guiding device 10. Between the sheet guiding surface 17 and the sheet 3 being guided thereabove, a supporting air cushion is preferably formed during operation. To that end, the sheet guiding device 10 is equipped with blown air nozzles which discharge into the sheet guiding surface 17; of these nozzles only one is shown symbolically in the form of a stub 18 in FIG. 1 as representative of all of them.

To prevent the printed sheets 3 in the pile 14 from sticking together, a dryer 19 and a dust applicator 20 are provided along the path of the sheets 3 from the drive chain wheels 7 to the sheet brake 11.

To avoid excessive heating of the sheet guiding surface 17 by the dryer 19, a coolant circuit is integrated with the sheet guiding device 10; this is symbolically suggested in FIG. 1 by an inlet stub 21 and an outlet stub 22 of a coolant tub 23 associated with the sheet guiding surface 17.

The aforementioned guide rails have not been shown in FIG. 1. However, their course is apparent from the course of the chain runs in this embodiment.

Figure 2:
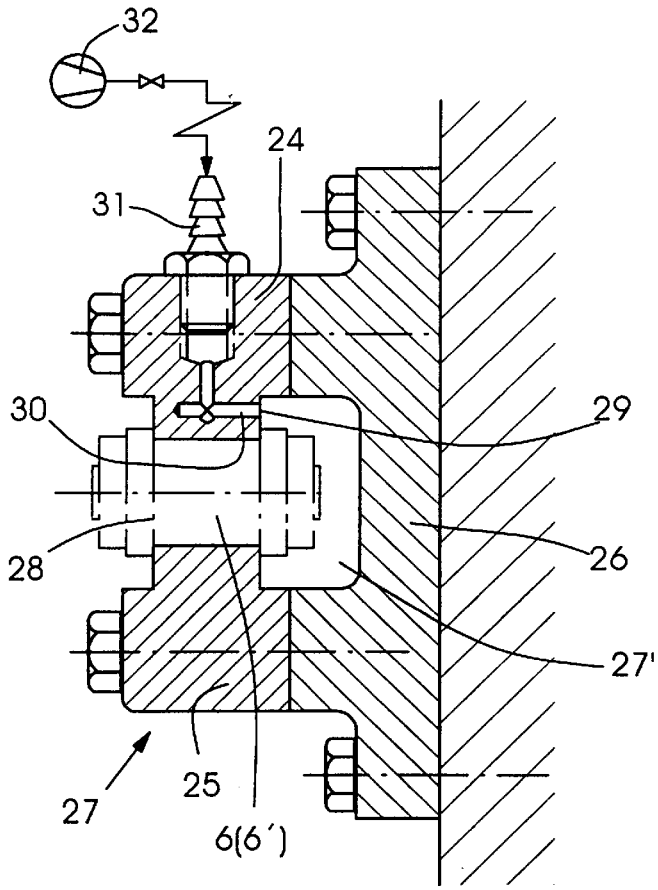
FIG. 2 is an enlarged cross-sectional view of FIG. 1 taken along the line II—II in the direction of the arrows and showing an actuator, formed by a conveyor chain, and a chamber partly surrounding the actuator, the chamber, in this case, being formed by guide rails and a holder carrying the rails.

In FIG. 2, the exemplary embodiment is shown, in a sectional view taken along the line II—II in FIG. 1, with an inner guide rail 24, an outer guide rail 25, and a holder 26 for supporting them. The guide rails 24 and 25 together with the holder 26 define a chamber 27 of approximately C-shaped cross section and thus form an interior 27' with an open long side 28, so that the chamber 27 partly surrounds the conveyor chain 6'. The physical separation shown here between the inner and outer guide rails 24 and 25 and the holder 26 is not mandatory, however.

Figure 3:
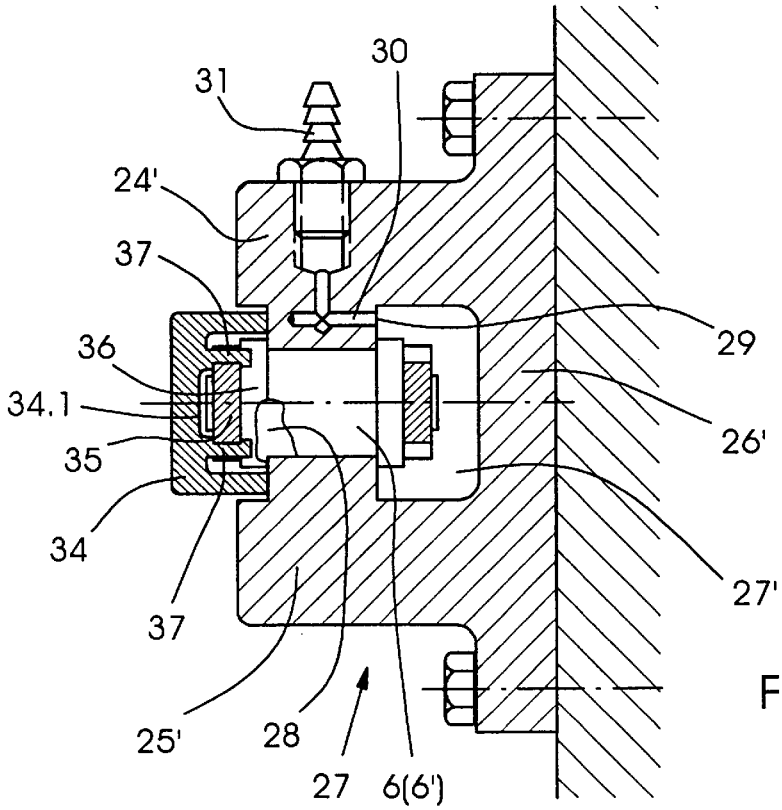
FIG. 3 is a view similar to that of FIG. 2, showing the conveyor chain with an improvement in the form of cover tabs disposed laterally thereon, the conveyor chain and the cover tabs covering an open long side of the interior of the chamber.

As shown by way of example in FIG. 3, a unipartite component forming the guide rails 24' and 25' and a holder 26' carrying them can also be provided.

In an exemplary embodiment shown in FIG. 4, a holder 26" for an inner guide rail 24" and an outer guide rail 25" can also be formed directly by one side wall of the portion of the printing press including the chain conveyor 4, the portion in this embodiment being the chain delivery 1.

The guide rails 24 and 25 embodied, for example, in accordance with FIG. 2, as mentioned hereinbefore, guide one of the two conveyor chains 6', respectively, along the paths between one of the drive chain wheels 7 and one of the deflection chain wheels 8.

In at least one section, respectively, along the engagement path of the conveyor chain 6' in the ring gear of the drive chain wheel 7 and deflection chain wheel 8, at least the inner guide rail 24 is interrupted, so that the interior 27', in addition to the open long side 28 thereof, has open end faces facing towards the drive chain wheel 7 and the deflection chain wheel 8. Thus, while the interior 27' is indeed open not only on the long side 28 thereof, but nevertheless closed to the greatest possible extent, it can itself be considered otherwise to be closed to the greatest extent when the interior 27' communicates in some places with the surroundings via gaps along the chain path determined by the interior 27', specifically via the gaps that are typically provided when guide rails are composed of individual rail segments.

Blown air openings 29 discharge into the interior 27' and, during operation, emit blown air and subject the interior 27' to a pressure that is greater than the pressure in the surroundings of the chamber 27. In the embodiment according to FIGS. 2 to 4, the blown air openings 29 are formed by bores 30 provided in the inner guide rail 24, 24' or 24"; these bores 30 are distributed over the length of the interior 27' that can be seen in cross section in FIGS. 2 to 4. Each bore 30 communicates with a respective nipple 31, that is screwed into the guide rail 24, 24' or 24" and, in turn, is connected, by a suitable connection not explicitly shown in the drawing, to a compressed air generator 32.

In an exemplary embodiment shown in FIG. 5, blown air openings 29' discharging into the interior 27' communicate with a blown air conduit 33 formed in the guide rail 24"'; the blown air conduit 33, in turn, communicates with the nipples 31 screwed into the guide rail 24"'. Here, not every blown air opening 29' has to have a respective nipple 31 assigned thereto.

The arrangement of the blown air openings 29 and 29', respectively, in one of the guide rails provided in the examples according to FIGS. 2 to 5 is not mandatory. Instead, for example, blown air openings discharging into the interior 27' can be provided in the holder 26, 26', or 26"; it is also possible to provide a blown air conduit analogous to the example of FIG. 5 in the respective holder 26, 26' or 26".

It is essential, respectively, here that blown air openings discharge into the interior 27' and maintain excess pressure therein by the blown air fed therein during operation. This excess pressure assures that floating or suspended substances from the surroundings cannot penetrate into the interior 27'.

Figure 6:
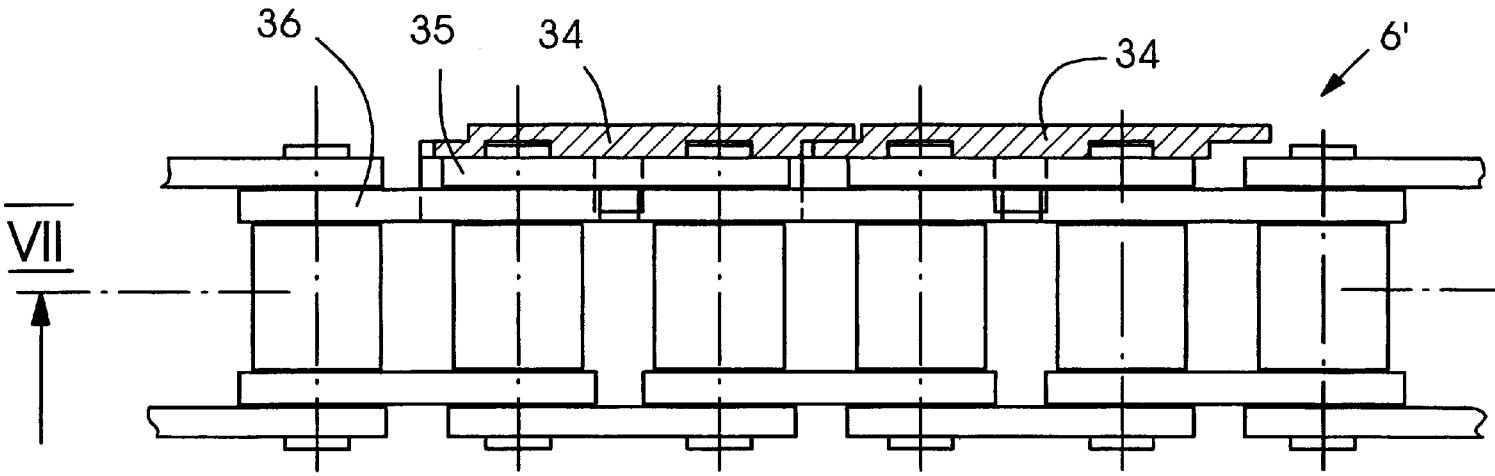
FIG. 6 is an enlarged fragmentary plan view of FIG. 1, showing a portion of the conveyor chain provided with the cover tabs, which are, in turn, shown in a sectional view taken along the axes of the chain bolts.

In the improvement shown in FIG. 3, a conveyor chain is provided having cover tabs 34 laterally secured thereto, which together with the conveyor chain 6' cover the open long side 28 of the interior 27'. On one side of the conveyor chain, that is formed by outer tabs 35 and inner tabs 36 pivotably connected to one another, a cover tab 34 is assigned to a respective outer tab 35 (note FIG. 6). In the example of FIG. 3, the cover tabs 34 have a substantially U-shaped cross section and are respectively provided, inside the U, with a pair of detent elements 37, which in situ engage the respective outer tab 35 from behind in the region of the narrowest cross section thereof, and thus form-lockingly connect the respective cover tab 34 to the respective outer tab 35. In this regard, it is noted that a form-locking connection is one that results from the form or shape of two connecting parts, as opposed to a force-locking connection resulting from a force application external to the connecting parts.

Figure 7:
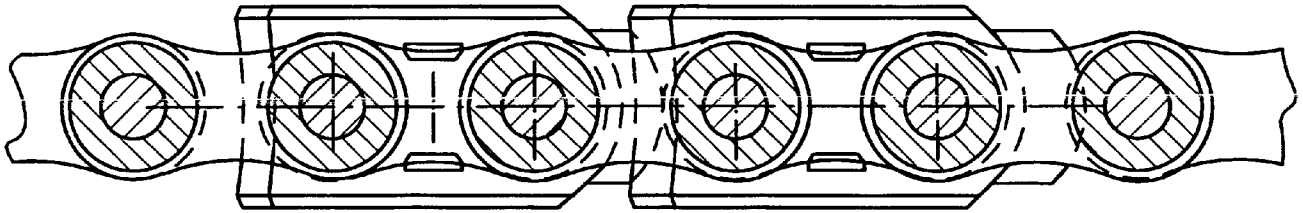
FIG. 7 is a longitudinal sectional view of FIG. 6 taken along the line VII—VII in the direction of the arrows.

A respective cover tab 34 extends along the respectively assigned outer tab 35 and protrudes past the ends thereof, with an end region graduated in such a manner that mutually opposing ends of the cover tabs 34 overlap. The outer contours of the graduated end regions are so formed that the ends overlapping one another allow a mutual relative motion upon a deflection of the conveyor chain 6' that occurs at a specific radius of curvature (note FIG. 7).

The inside of the base of the U of the U-shaped cover tab 34 is located, in this example, on the assigned outer tab 35, and a respective leg of the U extends towards the cover tabs 34 as far as a side face of the respective guide rails 24' and 25', respectively, so that the cover tabs 34, together with the outer tabs 35 that they encompass, and with the inner tabs 36 of one side of the conveyor chain 6', cover the open long side 28 of the interior 27'.

Thus, although complete sealing of the interior 27' is not provided, the cover tabs 34 do prevent a direct outflow from the interior in the region of the respective gaps between the inner tabs 36 that would otherwise occur, and they increase the flow resistance to the system formed without the cover tabs 34 by the interior 27' and the outer tabs 35 around which the flow passes, so that, given a suitably low flow rate through the interior 27', an adequate excess pressure can already be generated therein, and thus a correspondingly low-power blower 32 can be used to generate the blown air.

Complete sealing of the interior 27' is not worth striving for, because the air emerging, in particular, between facing ends of the cover tabs 34 forms air curtains, which effectively prevent the penetration of floating substances into the interior 27'. Furthermore, complete sealing would entail considerable friction problems. To avoid such problems, it is also provided that there be no direct contact between the legs of the U of the U-shaped cross section of the cover tabs 34 and the aforementioned side faces of the guide rails 24' and 25'.

A feature shown in FIG. 4 is the provision of cover tabs 34' which, together with the guide rails 24" and 25", form labyrinth seal gaps. To that end, compared to those of FIG. 3, the cover tabs 34' are modified so that the free ends of the legs of the U of the substantially U-shaped cross section of the cover tabs 34' are bent outwardly 90° and engage in respective longitudinal grooves 24".1 and 25".1 of the inner and outer guide rails 24" and 25", respectively.

In each case, the cover tabs 34 and 34', respectively, are preferably provided with indentations 34.1 and 34'.1, respectively, which form-lockingly engage around the protruding ends of the chain bolts. The cover tabs 34 and 34', respectively, are thus connectable to the conveyor chain 6' in a positionally secured manner by the detent elements 37.

The fastener that has been thus created overall ensures, on the one hand, that the shaping of the cover tabs 34 and 34', respectively, and, on the other hand, the mounting or assembly thereof on a standardized roller chain, are very simple.

Figure 8:
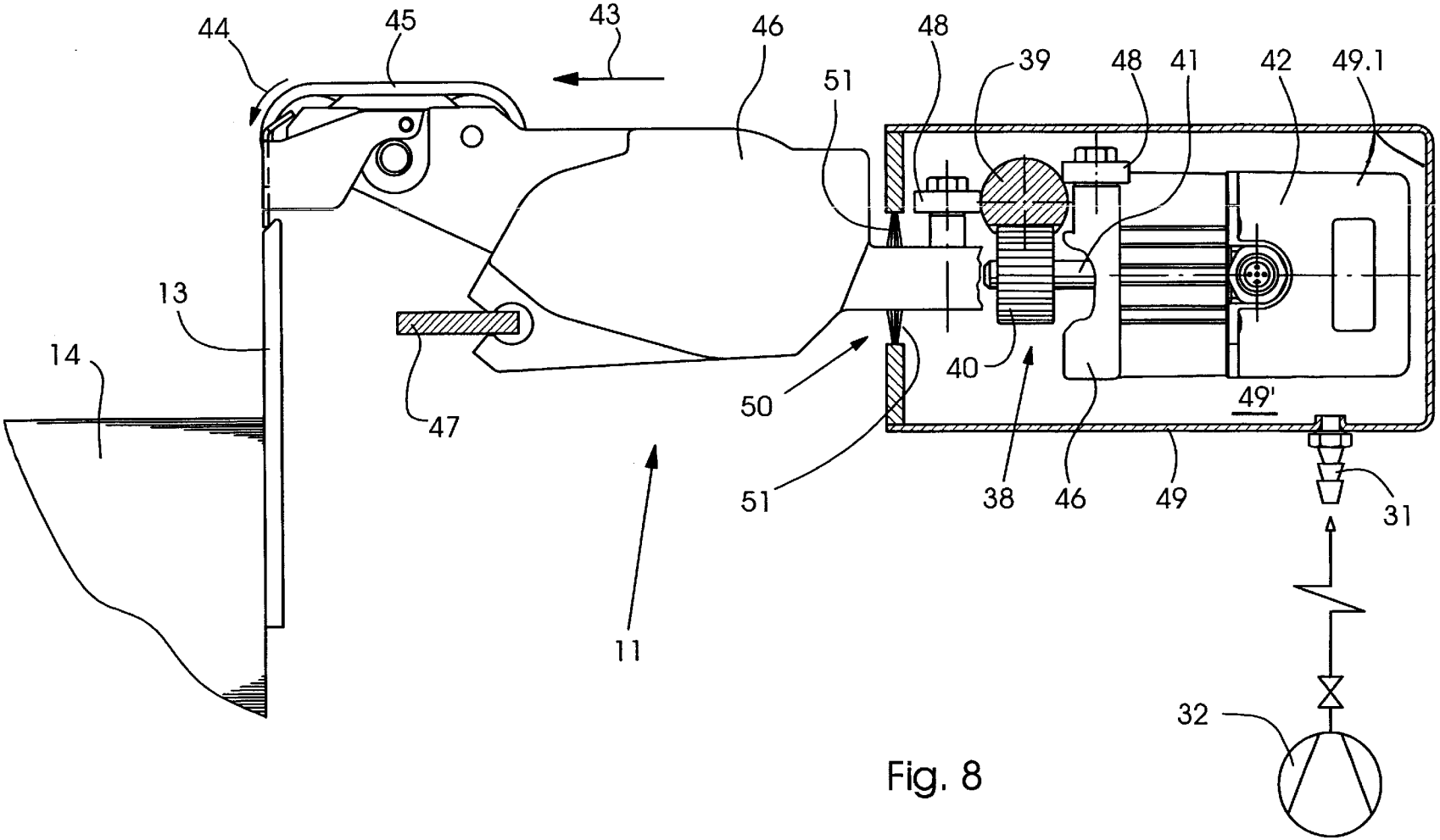
FIG. 8 is an enlarged fragmentary view, partly in section, showing an exemplary embodiment of the invention wherein the actuator includes a gear wheel meshing with a rack and forming part of an adjusting drive mechanism for shifting a sheet braking device of a sheet brake.

In the exemplary embodiment of the previously addressed sheet brake 11 shown in FIG. 8, an actuator 38 includes a gear wheel 40 that meshes with a rack 39 seen in cross section. The gear wheel 40 is a drive pinion that is connected to a power takeoff shaft 41 of an adjusting drive mechanism 42. The sheet brake identified overall by the reference numeral 11 in FIG. 8 is adjustable in and counter to the direction represented by the arrow 43, in order to adjust to the size or format of the sheets 3 that are brought, in the direction represented by the arrow 43, to the brake belts 45 revolving in the direction represented by the arrow 44. The sheet brake 11 includes a carriage 46 carrying the adjusting drive mechanism 42, the carriage 46 being braced at one side thereof on a crossbar 47 and on the other by rollers 48 on a rack 39. A chamber 49 partly surrounding the adjusting drive mechanism 42, the rollers 48, and thus the actuator 38, extends longitudinally of the rack 39 and, in the same manner as the rack 39 and the crossbar 47, is adjustable in and counter to the direction represented by the arrow 43. The adjusting equipment required overall for effecting the foregoing is conventional and therefore not shown.

The chamber 49, in a side wall thereof facing towards the pile 14, is formed with a longitudinal slit 50, protruding from which is an arm of the carriage 46, that carries the part of the carriage 46 on which the brake belt 45 is disposed that revolves during operation in the direction indicated by the arrow 44. The longitudinal slit 50 extends parallel to the rack 39 and is preferably shielded by a brush assembly 51. A respective end face 49.1 of the chamber 49 is closed.

A plurality of nipples 31 is preferably inserted into the wall of the chamber 49; as suggested in FIG. 8, these nipples communicate, during operation, with a compressed air generator 32, and a pressure that is greater than the pressure in the exterior surroundings of the chamber 49 is thus maintained in the interior 49' of the chamber 49. This prevents floating substances from penetrating into the interior 49' of the chamber 49 and thus offers effective protection of the actuator 38 against contamination by powder, in particular.

Figure 9:
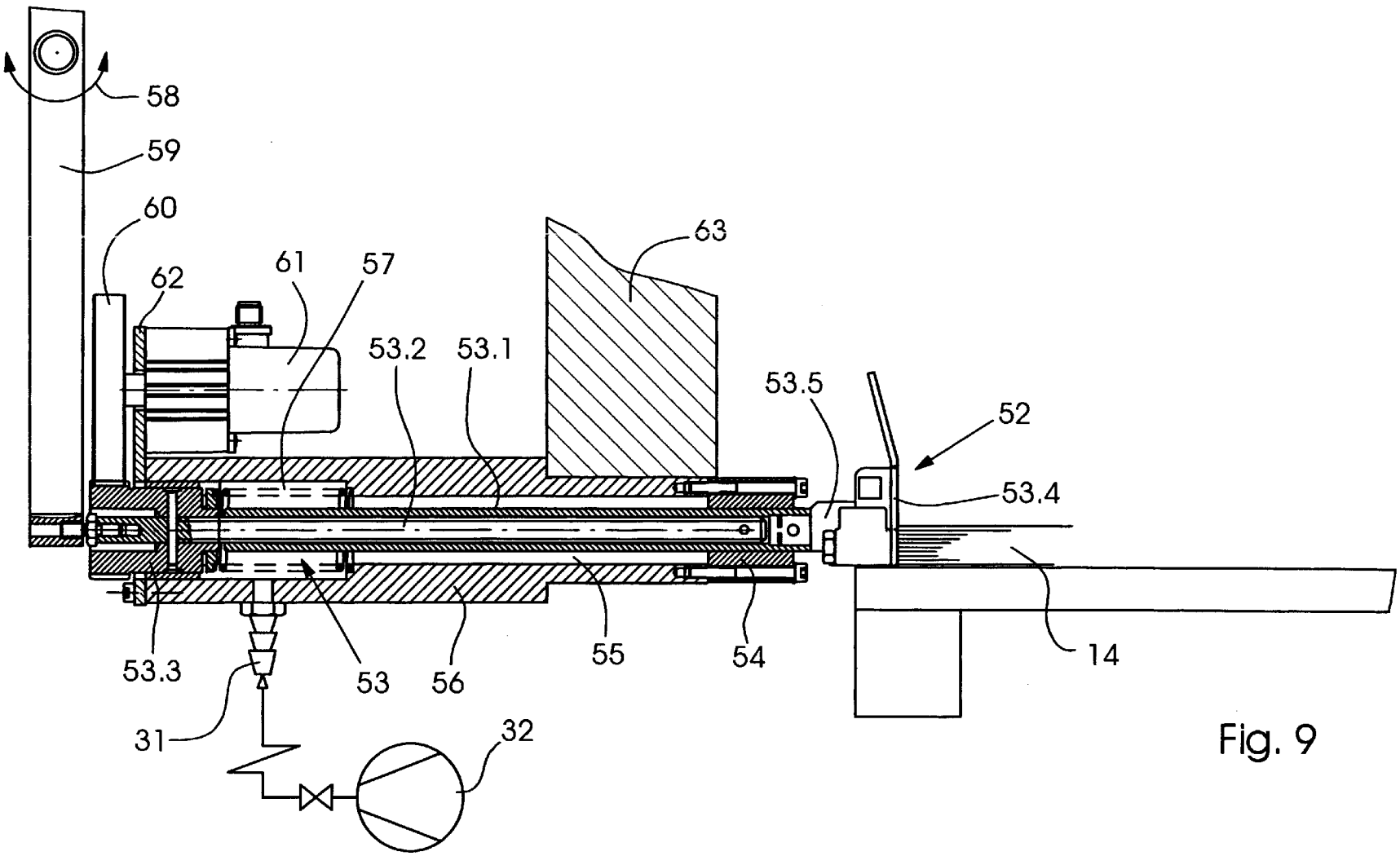
FIG. 9 is a view similar to that of FIG. 8 of another exemplary embodiment of the invention wherein the actuator is formed by a tappet oscillating axially during operation, and forming part of a sheet jogger.

In the exemplary embodiment shown in FIG. 9 of the herein previously addressed jogger, an actuator 52 includes a tappet 53 that oscillates axially during operation. This tappet 53 is composed of an elongated spindle nut 53.1 that is secured against rotation or torsion and is longitudinally displaceable; a threaded spindle 53.2 that engages the spindle nut 53.1; a bearing sleeve 53.3 firmly connected to the threaded spindle 53.2 at an end thereof distal from the pile 14; and an impact plate holder 53.5 carrying an impact plate assembly 53.4 and firmly connected to the spindle nut 53.1. The outer contour of the spindle nut 53.1 is formed as a square, and an end thereof facing towards the pile 14 is guided in a square socket block 54 that, in turn, is screwed onto a pile facing end face of an elongated sleeve 56 provided for forming a chamber 55, this sleeve 56 partly surrounding the actuator 52 formed by the tappet 53.

An inner shoulder of the sleeve 56, distal from the pile 14, supports a spring 57 that forces the end of the threaded spindle 53.2 distal from the pile 14 against a lever 59 that swings in the direction represented by the double arrow 58 during operation.

The bearing sleeve 53.3 guided in the sleeve 56 protrudes past the end of the sleeve distal from the pile 14 and, in the protruding end of the sleeve 53.3, it is formed with toothing that meshes with a gear wheel 60 that is connected to a power takeoff shaft of an adjusting drive mechanism 61. The adjusting drive mechanism 61 is flanged to a plate 62 which, in turn, is screwed onto the end face of the sleeve 56, that is distal from the pile 14.

It can be readily appreciated that actuation of the adjusting drive mechanism 61 causes a rotation of the threaded spindle 53.2 and thus an adjustment, along the threaded spindle, of the spindle nut 53.1 which, in the position thereof shown in FIG. 9 is adjusted to the maximum size or format of the sheets to be jogged.

The sleeve 56, fastened to a side wall 63 of the printing press by non-illustrated fasteners, and the square socket block 54 connected to the sleeve partly surround the actuator 52; that is, at least the end of the bearing sleeve 53.3 that is formed with toothing and the impact plate holder 53.5 protrude out of the chamber 55.

Between the square socket block 54 and the spindle nut 53.1, there are also gaps in the corner regions of the square profiles of these elements, those gaps providing communication between the interior of the chamber 55 and the atmosphere surrounding the chamber 55 and, without the excess pressure prevailing during operation in the chamber 55, would cause contamination of this interior, particularly with powder, that could cause functional problems. This is counteracted by inserting a nipple 31, operationally connected to a compressed air generator 32, into the sleeve 56, so that, during operation, excess pressure is maintained in the interior of the chamber 55 that prevents the penetration of floating substances into this chamber.

We claim:

1. A printing press comprising:

an actuator formed by a conveyor chain;

cover tabs secured to said conveyor chain;

guide rails for guiding said conveyor chain;

a holder for carrying said guide rails; and a chamber partly surrounding said actuator; said chamber defining an interior, an open long side, and outer surroundings outside said chamber having a given pressure; said chamber having a pressure prevailing therein greater than the given pressure; said interior of said chamber being formed by said holder, together with said guide rails; said open long side being covered substantially by said cover tabs and said conveyor chain, said chamber being otherwise closed to a maximum possible extent.

2. The printing press according to claim 1, wherein the actuator includes a gear wheel meshing with a rack.

* * * * *